United States Patent [19]

Dieppedalle et al.

[11] Patent Number: 4,725,911

[45] Date of Patent: Feb. 16, 1988

[54] ELECTRICAL CIRCUIT BREAKER-CONTACTOR, NOTABLY FOR CAPACITOR BANKS

[75] Inventors: François Dieppedalle, Poisat; Jean-Luc Mertz, Grenoble, both of France

[73] Assignee: Merlin Gerin, France

[21] Appl. No.: 879,959

[22] Filed: Jun. 30, 1986

[30] Foreign Application Priority Data

Jul. 4, 1985 [FR] France ..... 85 10394

[51] Int. Cl.[4] ..... H01H 73/18

[52] U.S. Cl. ..... 361/8; 335/6; 361/115

[58] Field of Search ..... 361/7, 8, 13, 115; 335/6, 156, 159, 162

[56] References Cited

U.S. PATENT DOCUMENTS

| | | | |
|---|---|---|---|
| 3,430,016 | 2/1969 | Hurtle | 361/13 |
| 3,466,503 | 9/1969 | Goldberg | 361/13 |
| 4,531,172 | 7/1985 | Mertz | 361/115 |
| 4,626,951 | 12/1986 | Nagao | 361/13 |

FOREIGN PATENT DOCUMENTS

| | | |
|---|---|---|
| 0104981 | 4/1984 | European Pat. Off. . |
| 1590945 | 1/1954 | France . |
| 1050982 | 5/1970 | France . |

*Primary Examiner*—Philip H. Leung
*Assistant Examiner*—Jeffrey A. Gaffin
*Attorney, Agent, or Firm*—Parkhurst & Oliff

[57] ABSTRACT

The circuit breaker-contactor includes a circuit breaker part with mechanical contacts and a contactor part with mechanical contacts connected in series. A solid-state switch is connected in parallel to the contacts of the contactor part. A control unit controls the solid-state switch and the contactor part, in such a way as to close the circuit when the potential difference passes zero by conduction or interrupting the solid-state switch. The mechanical contacts perform only current conduction by shunting the switch in normal operation. The contacts of the circuit breaker part have associated with them an arcing electrode and a shunt circuit disposed to draw the arc, as soon as the contacts open, and to shunt the solid-state switch and contactor part mechanical contacts assembly.

11 Claims, 5 Drawing Figures

ELECTRICAL CIRCUIT BREAKER-CONTACTOR, NOTABLY FOR CAPACITOR BANKS

BACKGROUND OF THE INVENTION

The invention relates to an alternating current circuit breaker-contactor, notably connecting capacitor banks, comprising per pole a first and a second pair of mechanical contacts, electrically connected in series:

a remote control electromagnet for opening and closing the first pair of mechanical contacts;

an automatic tripping mechanism on a fault opening the second pair of mechanical contacts;

at least one arcing electrode located in proximity to one of the contacts of the second pair to catch the arc drawn when the contacts of the second pair separate.

In a circuit breaker-contactor of the kind mentioned, the first pair of mechanical contacts performs the function of a contactor to make or break the capacitor bank, whereas the second pair of mechanical contacts performs the function of a protective circuit breaker in the event of short-circuits or overloads occurring. The circuit breaker-contactor can be controlled by a varmetric relay allowing making by capacitor banks. The mechanical contacts, ensuring normal making or breaking, have a high endurance, whereas the contacts of the circuit breaker part resist the action of an arc drawn when opening occurs on a short-circuit. Circuit breaker-contactors of the kind mentioned have the drawback that the mechanical contacts of the contactor part wear, due to current peaks of short duration occurring on closing of a capacitive circuit. These current peaks cause micro-bondings of the contacts and rapid erosion of the latter.

SUMMARY OF THE INVENTION

The object of the present invention is to achieve a high endurance circuit breaker-contactor providing total protection.

The circuit breaker-contactor according to the invention is characterized by the fact that the arcing electrode belongs to a shunt circuit of the first pair of contacts to draw off the current flowing through the first pair of contacts to the shunt circuit as soon as the arc is switched onto the electrode.

A solid-state switch, notably a triac or thyristor, is connected to the terminals of the first pair of contacts in parallel with the shunt circuit, and a zero current detector controls triggering of the solid-state switch when the potential difference between the alternating current source and the capacitor reaches zero, on a closing order of the first pair of mechanical contacts with a time lag such that current making is always performed by the solid-state switch.

The solid-state switch, notably the triac, enables closing of the circuit to be synchronized, avoiding or limiting current peaks, but it has the drawback of an appreciable voltage drop and a great sensitivity to short-circuits. The voltage drop causes an appreciable temperature rise, and according to the invention, the triac is shunted in normal operation by the mechanical contacts of the contactor. The solid-state switch only operates for a short time at the moment the circuit breaker-contactor closes and possibly when the latter opens. To avoid the solid-state switch being destroyed in the event of a fault or a short-circuit, the circuit breaker-contactor according to the invention comprises a shunt circuit which operates by switching the arc onto an arcing electrode, as soon as the contacts of the circuit breaker part open. The shunt circuit draws the current off to protect the solid-state switch. It can easily be seen that the circuit breaker part provides protection of the capacitors and of the line against overloads and short-circuits, and protects the solid-state switch and the contacts of the contactor part against short-circuits. The contacts of the contactor part are protected against current peaks by the solid-state switch which closes before the mechanical contacts and which opens after the latter. The solid-state switch provides a synchronized opening order when the current passes zero.

The circuit breaker-contactor is advantageously of the narrow or miniature molded case type, all the parts which make it up being housed in a single case or according to a preferred embodiment in separate cases allowing modular assembly. The solid-state switch, the dimensions of which are relatively small, is advantageously incorporated either in the case of the circuit breaker part or in that of the contactor, so as to limit the electrical connections. The circuit breaker comprises a thermal trip release and an electromagnetic trip release, which may be replaced by an electronic trip releases well known in the art. A reset and/or manual control handle enables the circuit breaker contacts to be opened and closed in order to break the circuit. The contactor preferably comprises a contact bridge actuated in the closing position when an electromagnet is energized, and brought back to the opening position by a return spring when this electromagnet is de-energized. The contactor may also be of the pulse control type, each pulse causing a status change in the manner of impulse relays.

BRIEF DESCRIPTION OF THE DRAWINGS

Other advantages and characteristics will become more clearly apparent from the following description of an embodiment of the invention, given as an example only and represented by the accompanying drawings, in which.

DESCRIPTION OF THE PREFERRED EMBODIMENT

Figure 1:
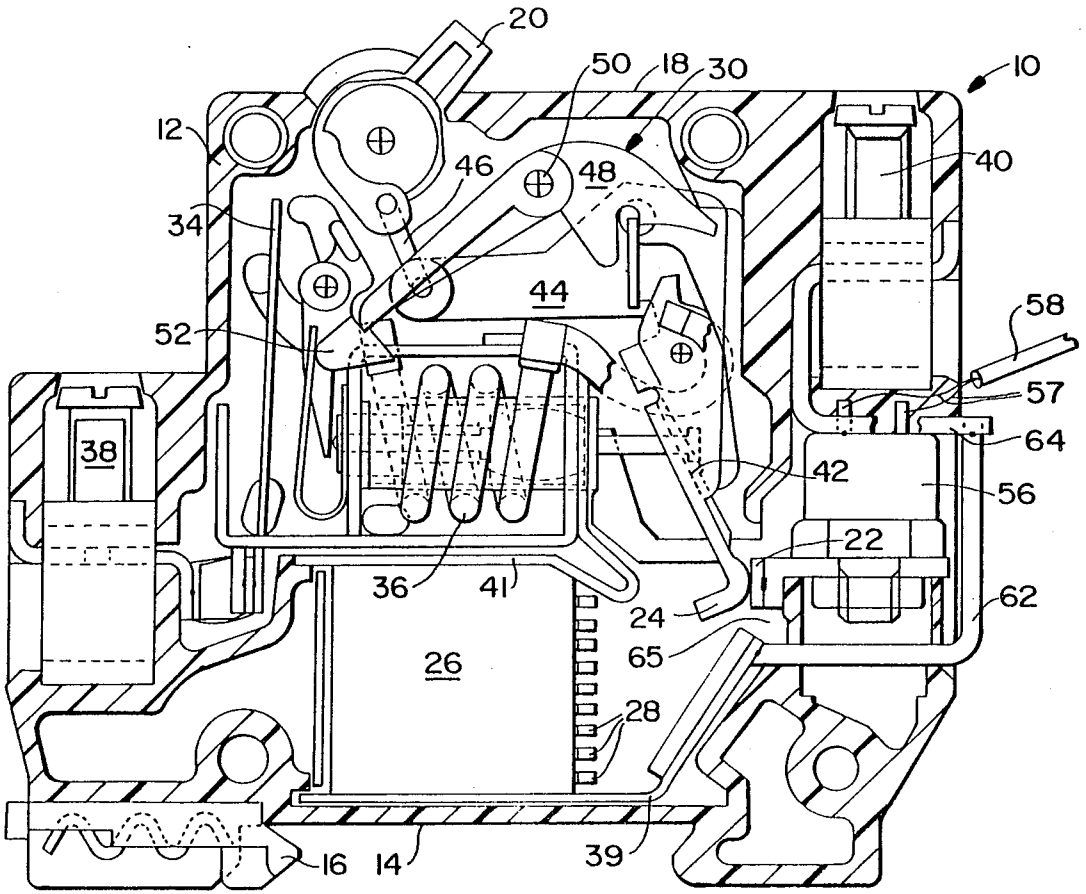
FIG. 1 is an elevational axial cross-sectional view of the circuit breaker part of the circuit breaker-contactor according to the invention.

FIG. 1 corresponds to that of the U.S. Pat. No. 4,531,172, which will be referred to advantageously for further details on the operation of the circuit breaker/-solid-state switch combination. In FIG. 1, a miniature molded case 12 is shown, containing the circuit breaker part designated by the general reference 10. The case 12 comprises on its rear face 14 a fixing slide 16 and on its front part 18 a control handle 20 of a mechanism 30. A pair of fixed 22 and moving contacts 24 are fitted facing an arc chute 26 with deionization plates 28. The end plates of the arc chute 26 are extended in the direction of the contacts 22, 24, to form arcing horns 39, 41. The moving contact 24 is securedly united to a contact arm 42, pivotally mounted on a rocker 44, actuated by a toggle-joint 45, articulated on the handle 20. A trip lever 48 pivotally mounted on a spindle 50 cooperates both with the contact arm 42 and with a locking bolt 52, which is actuated by a bimetallic strip 34 and/or electromagnetic trip release 36. The electrical circuit comprises an input terminal 38 and an output terminal 40 between which the bimetallic strip 34, the coil of the electromagnetic trip release 36, the contacts 22, 24, and a solid-state switch 56 are connected successively in series. The solid-state switch 56 is, for example, a triac or a pair of end-to-end mounted thyristors whose control electrode is connected to a terminal 57 of the case 12, accommodating a control wire 58. The arcing horn or electrode 39 extends in the proximity of the fixed contact 22, leaving a small gap 65. The arcing horn 38 is connected by a conductor 62 to a point 64, located between the solid-state switch 56 and the terminal 40.

Operation of this circuit breaker/solid-state switch part is set out in the foregoing description and in the above-mentioned U.S. Pat. No. 4,531,172. In normal operation, the contacts 22, 24, are closed, the solid-state switch ensuring opening and closing of the circuit operating as a remote controlled contactor. Protection is provided by the circuit breaker whose trip releases 34, 36 cause the contacts 22, 24 to open if an overload or short-circuit occurs. As soon as the contacts 22, 24 separate, the arc drawn between these contacts switches to the electrode 39 closing the shunt circuit 62, to draw off the current flowing through the solid-state switch 56. This current drawing protects the triac or the thyristors of this solid-state switch. After the arc has been blown out in the arc chute 26, the circuit is interrupted.

Figure 3:
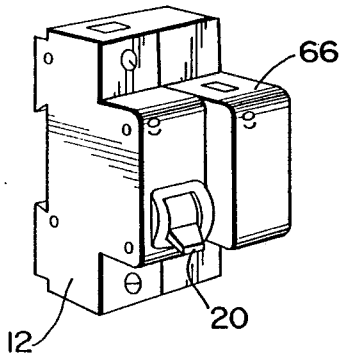
FIG. 3 is a schematic perspective view of the assembled circuit breaker and contactor parts.
Figure 2:
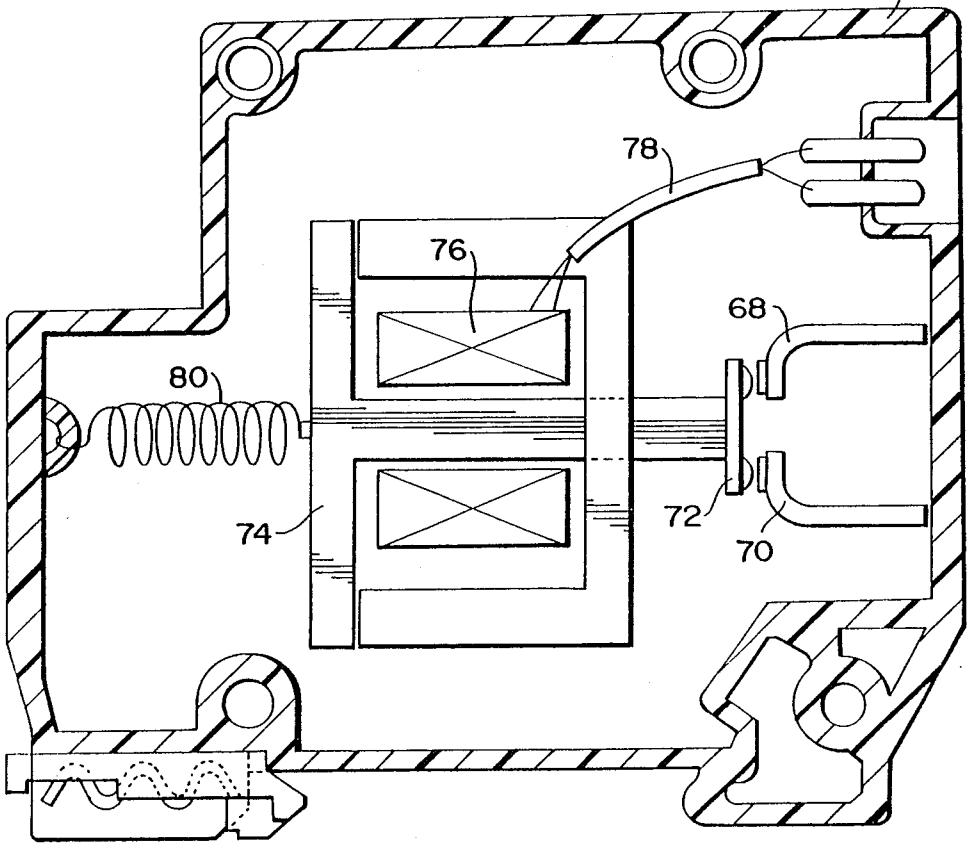
FIG. 2 is a similar view to that of FIG. 1, illustrating the contactor part.
Figure 4:
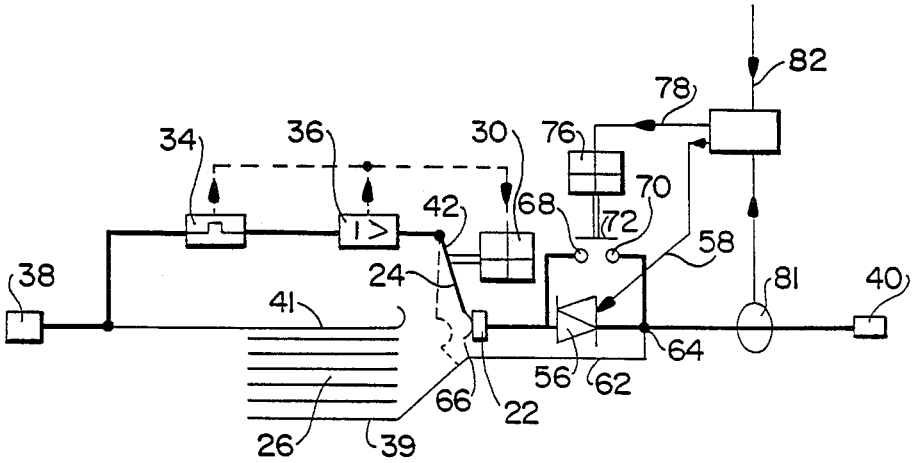
FIGS. 4 and 5 show the single-pole diagrams of two alternative embodiments of the invention.

Referring more particularly to FIGS. 2 and 3, it can be seen that the circuit breaker case 12 has adjoining it a contactor case 66 of the same profile, containing a pair of fixed contacts 68, 70 cooperating with a contact bridge 72. The contact bridge 72 is securely fixed to an armature 74, controlled by an electromagnet 76. When the electromagnet 76 is supplied by a conductor 78, the armature 74 is attracted and the contact bridge 72 closed. A return spring 80 urges the contact bridge 72 into the opening position, as soon as the power supply to the electromagnet 76 is interrupted. The fixed contact 70 is connected to one of the terminals of the solid-state switch 56, whereas the opposing fixed contact 68 is connected to the other terminal, for example to the point 64 of the solid-state switch 56. The conductor 78 is connected to the control unit 60, which also receives a control signal delivered by a detector 81 and an external control signal 82 (see also, FIGS. 4 and 5).

The circuit breaker-contactor according to the invention operates in the following way:

the contacts 22, 24 of the circuit breaker part are normally closed. A closing order of the circuit breaker-contactor according to the invention is sent by the conductor 82 to the control unit 60. The latter receives from the detector 81 the information relating to the alternating current to transmit to the trigger or control electrode 58 of the switch 56 a conduction order when the potential difference between the mains and the capacitor passes zero. The control unit 60 also sends, as soon as the solid-state switch 56 closes, a closing order of the contacts 68, 70, 72 of the contactor part. As soon as these mechanical contacts 68, 70, 72 are closed, the solid-state switch 56 is shunted and almost all the current flows through the mechanical contacts 68, 70, 72, which have a lower electrical resistance. Overheating of the solid-state switch 56 is thus avoided. An opening order transmitted by the conductor 82 to the control unit 60 similarly causes opening of the mechanical contacts 68, 70, 72, followed by opening of the solid-state switch 56 when the current passes zero. It can easily be seen that the mechanical contacts 68, 70, 72 ensure current conduction, whereas the solid-state switch 56 performs current making and breaking.

if a short-circuit occurs, detected by the trip release 34, 36 of the circuit breaker part, the moving contact 24 moves at high speed drawing an arc between the contacts 22, 24. The arc root anchored on the fixed contact 22 quickly switches onto the arcing electrode 39, allowing the current to flow via the shunt conductor 62. It can be seen that drawing the current off via the shunt conductor 62 protects both the solid-state switch 56 and the contacts 68, 70, 72. The circuit breaker furthermore protects the circuit connected downstream, notably the capacitor (not shown). Remaking of the circuit breaker by means of the handle 20 enables the circuit breaker-contactor to be reset for a fresh closing operation.

Figure 5:
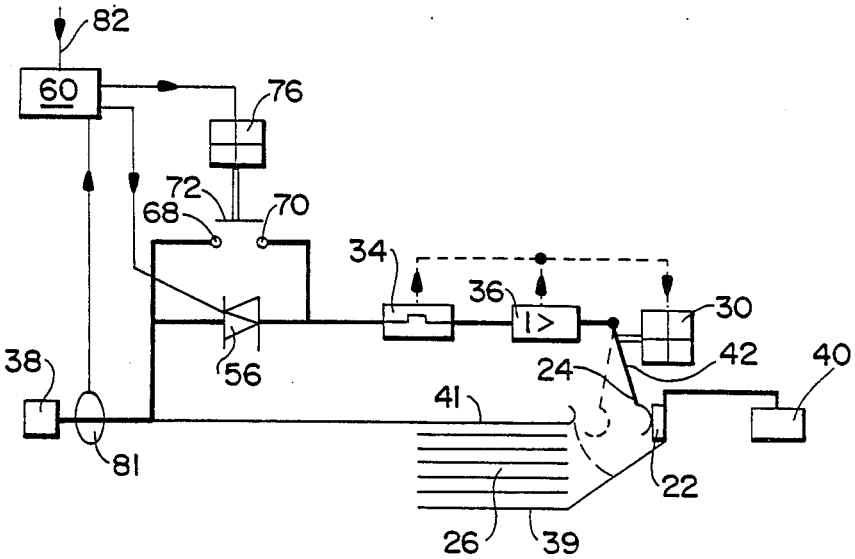

FIG. 5 illustrates an alternative embodiment, wherein the arcing electrode 41 is associated with the moving contact 24, in such a way as to draw the arc anchored on this moving contact 24. The solid-state switch 56 is, in this case, fitted between the moving contact 24 and the terminal 38 associated with contact 24. The mechanical contacts 68, 70, 72 are connected in the manner described above to the terminals of the switch 56, the control unit 60 controlling in the same way the solid-state switch 56 and the electromagnet 76 of the contactor part. Operation naturally remains identical to that described above, the circuit breaker performing all the protective functions, as soon as the arc is switched onto the electrode 41.

It is clear that all the parts can be housed in a single case which may have a different profile. The modular system presents the advantage of enabling standard parts to be used, for example a contactor element or impulse relay 66, comprising a suitable electrical connection system. The solid-state switch has been housed in the case 12 of the circuit breaker part, but it is clear that this switch may be housed in a separate case or even in the case 66 of the contactor part. Similarly, the control unit 60 may be an independent part, which may be remote from the circuit breaker-contactor or housed in one of these cases.

What we claim is:

1. An alternating current circuit breaker-contactor comprising, per pole:

a first and a second pair of mechanical contacts, electrically connected in series;

a remotely controlled electromagnet for opening and closing said first pair of mechanical contacts;

an automatic tripping mechanism for opening said second pair of mechanical contacts on a fault;

at least one arcing electrode located in proximity to one of the contacts of said second pair to catch an arc drawn when the contacts of said second pair open;

a shunt circuit of said first pair of contacts, comprising said arcing electrode to draw off the current flowing through said first pair of contats to the shunt circuit as soon as the arc is switched onto said electrode;

a solid-state switch connected to the terminals of said first pair of contacts in parallel with said shunt circuit; and a detector controlling triggering of said solid-state switch when voltage across said solid-state switch reaches zero, on a closing order of said first pair of mechanical contacts with a time lag such that current making is always performed by the solid-state switch.

2. A circuit breaker-contactor according to claim 1, wherein said detector controls turning off of the solid-state switch when a current through the solid-state switch passes zero, on an opening order, after opening of said first pair of mechanical contacts.

3. A circuit breaker-contactor according to claim 1, comprising a control device which receives a synchronization signal sent by said detector and a remote control signal and sends a control order to said electromagnet and a control order to said solid-state switch.

4. A circuit breaker-contactor according to claim 3, wherein said control device comprises a time delay device to delay closing of said first of mechanical contacts in relation to closing of said solid-state switch and to delay opening of the solid-state switch in relation to closing of said first pair of contacts.

5. A circuit breaker-contactor according to claim 1, wherein said tripping mechanism comprises an instantaneous trip release for high-speed opening of said second pair of mechanical contacts in the event of a short-circuit.

6. A circuit breaker-contactor according to claim 1, wherein said arcing electrode is located in proximity to a fixed contact of said second pair to catch an arc root anchored on said fixed contact, and wherein said first pair of mechanical contacts and the solid-state switch are connected between said fixed contact and an associated terminal of said circuit breaker-contactor.

7. A circuit breaker-contactor according to claim 1, wherein said arcing electrode is located in proximity to a moving contact of said second pair, and wherein said first pair of mechanical contacts and the solid-state switch are connected between said moving contact and an associated terminal of said circuit breaker-contactor.

8. A circuit breaker-contactor according to claim 1, further comprising a varmetric relay for controlling opening or closing of said first pair of mechanical contacts in conjunction with the solid-state switch.

9. A circuit breaker-contactor according to claim 1, wherein said solid-state switch is a triac.

10. A circuit breaker-contactor according to claim 1, wherein said solid-state switch is a thyristor.

11. A circuit breaker-contactor according to claim 1, wherein said instaneous trip release is electromagnetic.

* * * * *